United States Patent [19]

Mildner

[11] 4,010,315

[45] Mar. 1, 1977

[54] SHIELDING TAPE FOR CABLES

[75] Inventor: Raymond C. Mildner, Lake Jackson, Tex.

[73] Assignee: The Dow Chemical Company, Midland, Mich.

[22] Filed: Apr. 25, 1975

[21] Appl. No.: 571,839

[52] U.S. Cl. ..... 174/107; 29/195; 29/197.5; 174/106 R

[51] Int. Cl.[2] ..... H01B 7/22

[58] Field of Search ..... 29/195 P, 197.5; 174/36, 102, 107, 126 CP, 106 R

[56] References Cited

UNITED STATES PATENTS

| | | | |
|---|---|---|---|
| 1,873,470 | 8/1932 | Peek et al. | 29/197.5 X |
| 3,235,961 | 2/1966 | Champion et al. | 29/197.5 X |
| 3,681,515 | 8/1972 | Mildner | 174/107 |
| 3,790,694 | 2/1974 | Portinari | 174/36 X |

*Primary Examiner*—L. Dewayne Rutledge
*Assistant Examiner*—E. L. Weise
*Attorney, Agent, or Firm*—Arthur J. Young

[57] ABSTRACT

A cable shielding tape comprising a first layer of substantially pure aluminum bonded to a second layer of aluminum alloy which can beneficially be used in cable constructions designed for the transmission of electric power or communications. The cable shielding tape may be formed as a strip having one or both sides coated with or laminated to an adhesive thermoplastic resinous polymer. The tape is disposed within a cable at the desired location to provide good mechanical and electrical properties therein. In addition to providing good mechanical and electrical properties for a cable, the aluminum/aluminum alloy shielding tape substantially reduces the problem of bi-metallic galvanic corrosion caused as a result of interfacing metals having widely differing electrolytic potentials.

30 Claims, 3 Drawing Figures

SHIELDING TAPE FOR CABLES

BACKGROUND OF THE INVENTION

1. Field of the Invention

This invention relates to cable constructions designed for the transmission of power or communications, with more specific reference to improved cable constructions wherein a multilayer metal element of substantially pure aluminum bonded to an aluminum alloy is utilized as a shield therein to provide protective electrical and mechanical properties, particularly good galvanic corrosion protection.

2. Description of the Prior Art

In general, the design of cables, whether for the transmission of power or communications, is dependent on their use in aerial, submarine, or underground service and in high or low voltage or frequency applications. The use of metallic shields in such cable constructions is well known. In cable designs, the outer shield or return conductor has many functions to perform. First, it has to carry, or be capable of carrying in the case of a malfunction or emergency, an electrical current. The source of this current might be the charging current due to capacitance of the cable, an out of balance current in a three-phase system, a current due to a fault in the cable, or a current initiated by a lightning stroke. The electrical characteristics of the shield are dictated by the overall service requirements of the cable. Usually, these electrical service requirements will dominate other requirements of the cable.

In addition, the outer shield must provide some mechanical protection to that part of the cable which provides the electrical service for which it is designed. For example, a cable may be subjected to mechanical damage while it is being installed, particularly in the case of an underground cable being laid by machine. Also, rocks in the backfill may exert excessive local pressures on an underground cable or the cable may be damaged in the course of subsequent digging near the same. Another important hazard to which underground cables are exposed and must be protected against by the outer shield is the gnawing of rodents. Finally, the outer shield should provide an hermetic seal to guard against the entrance of moisture into the working parts of the cable.

In many cases, where the primary function of the cable is not critical or where the cable can be installed in a protective environment, a single material can be found to provide a satisfactory shield. In other cases, the electrical and mechanical requirements noted above are mutually conflicting. For example, relatively pure copper or aluminum are excellent materials for satisfying the electrical requirements of the outer shield because of their high electrical conductivity, but do not satisfy the mechanical requirements since they are soft and ductile in their pure form. In like manner, the material most commonly used for mechanical protection in the shield is steel since it can be made very strong, but it will not satisfy the electrical requirements of the outer shield because of its low electrical conductivity. Under these circumstances, composite shields of aluminum or copper and steel have been used as illustrated in U.S. Pat. Nos. 3,183,300 and 3,272,911. Unfortunately, steel has little inherent resistance against corrosion unless very costly nickel or manganese alloys are used. Furthermore, composite shields of aluminum or copper and steel lead to additional problems of bi-metallic galvanic corrosion which is the result of interfacing metals having widely differing electrolytic potentials as in the case of aluminum or copper and steel.

SUMMARY

In general, the present invention provides a cable shielding tape comprising a first layer of substantially pure aluminum bonded to a second layer of aluminum alloy which tape can benefically be used in cable constructions designed for the transmission of electrical power or communications. The aluminum alloy is selected for properties which will satisfy the mechanical requirements of the shielding tape and the substantially pure aluminum layer is selected to provide the necessary electrical requirements of the tape. The aluminum alloy is further selected so that its electrolytic potential is not very different from that of the substantially pure aluminum thereby substantially reducing the problem of bi-metallic galvanic corrosion of the shielding tape. The cable shielding tape may be formed as a strip having one or both sides coated with or laminated to an adhesive thermoplastic resinous polymer to further reduce corrosion problems.

Accordingly, an objective of the present invention is to provide a cable shielding tape which can beneficially be used in cable constructions designed for the transmission of electric power or communications. Another object of the present invention is to provide a cable shielding tape with good mechanical and electrical properties having a first layer of substantially pure aluminum bonded to a second layer of aluminum alloy which will reduce the problem of bi-metallic galvanic corrosion caused as a result of interfacing metals having widely differing electrolytic potentials. A still further object of the present invention is to provide an aluminum/aluminum alloy multilayer bonded shielding tape having one or both sides coated with or laminated to an adhesive thermoplastic resinous polymer to provide further corrosion protection.

BRIEF DESCRIPTION OF THE DRAWINGS

The objects and advantages of the present invention are even more apparent when taken in conjunction with the accompanying drawings in which like characters of reference designate corresponding materials and parts throughout the several views thereof, in which.

DESCRIPTION OF THE PREFERRED EMBODIMENTS

The following description illustrates the manner in which the principles of the invention are applied but is not to be construed as limiting the scope of the invention.

Figure 1:
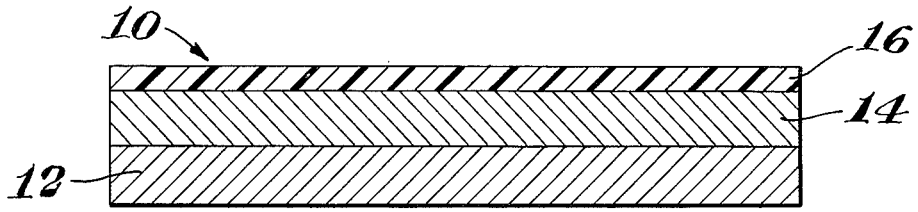
FIG. 1 is an exaggerated cross-sectional view of a cable shielding tape including a layer of adhesive thermoplastic resinous polymer according to the principles of the present invention.
Figure 2:
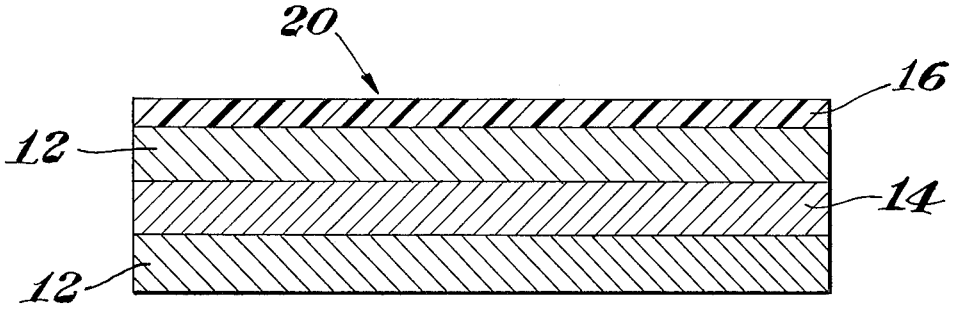
FIG. 2 is a cross-sectional view like FIG. 1 only showing a modified cable shielding tape.

More specifically referring to FIGS. 1 and 2, cable shielding tapes 10 and 20 are illustrated. The tapes 10 and 20 include a layer 12 of substantially pure electrical grade aluminum securely bonded to a layer 14 of aluminum alloy having good mechanical properties. Improved electrical properties can be achieved in the shielding tape 20 by sandwiching the aluminum alloy layer 14 between layers 12 of substantially pure aluminum as illustrated in FIG. 2. Although the multilayer structure of layers 12 and 14 will provide a satisfactory shielding tape for some cable constructions, it is preferred that an additional layer 16 of thermoplastic resinous polymeric material be adhered to layers 12 and 14 in tapes 10 and 20 to provide additional corrosion protection. The aluminum and aluminum alloy layers 12 and 14 may be bonded together with known adhesives as illustrated in U.S. Pat. No. 3,183,300, but are preferably adhered together by solid phase metallurgical bonding illustrated in U.S. Pat. No. 3,272,911.

Any known thermoplastic resinous polymeric material such as polyolefins, polyvinyl chloride and the like can be used to form layer 16. However, an ethylene copolymer with ethylenically unsaturated carboxylic acid which readily forms a strong adhesive bond with aluminum is preferred. Copolymers of ethylene and ethylenically unsaturated carboxylic acids useful in achieving the present invention are well described in U.S. Pat. No. 3,795,540, which patent is herein fully incorporated by reference thereto. More specifically, the adhesive polymer which is beneficially used in accordance with this invention is a normally solid thermoplastic polymer of ethylene modified by monomers having reactive carboxylic acid groups, particularly a copolymer of a major proportion of ethylene and a minor proportion, typically from about 1 to about 30, preferably from about 2 to about 20, percent by weight, of an ethylenically unsaturated carboxylic acid. Specific examples of suitable such ethylenically unsaturated carboxylic acids (which term includes mono- and poly-basic acids, acid anhydrides, and partial esters of polybasic acids) are acrylic acid, methacrylic acid, crotonic acid, fumaric acid, maleic acid, itaconic acid, maleic anhydride, monomethyl maleate, monoethyl maleate, monomethyl fumarate, monoethyl fumarate, tripropylene glycol monomethyl ether acid maleate, ethylene glycol monophenyl ether acid maleate, etc. The carboxylic acid monomer is preferably selected from $\alpha,\beta$-ethylenically unsaturated mono- and polycarboxylic acids and acid anhydrides having from 3 to 8 carbon atoms per molecule and partial esters of such polycarboxylic acids wherein the acid moiety has at least one carboxylic acid group and the alcohol moiety has from 1 to 20 carbon atoms. The copolymer may consist essentially of ethylene and one or more of such ethylenically unsaturated acid comonomers or can also contain small amounts of other monomers copolymerizable with ethylene. Thus, the copolymer can contain other copolymerizable monomers including an ester of acrylic acid. The comonomers can be combined in the copolymer in any way, e.g., as random copolymers, as block or sequential copolymers, or as graft copolymers. Materials of these kinds are readily known to the art. Thus, copolymers of ethylene and the specified ethylenically unsaturated acids are made by subjecting a mixture of the starting monomers to elevated temperatures, usually from about 90° C to about 300° C, preferably from about 120° C to about 280° C, and at higher pressures, usually above 1000 atmospheres, preferably between 1000 and 3000 atmospheres, preferably in the presence of a free radical initiator such as oxygen, a peroxygen compound, or an azo compound.

When the aluminum and aluminum alloy layers 12 and 14 are coated with the adhesive thermoplastic resinous polymeric material in practice of this invention, the coating can be applied in known manner by melt extrusion, powder spraying with flame or hot gas gun, by passing the heated part, e.g., the combined layers 12 and 14, through a fluidized polymeric powder bed, by casting from a solvent solution, or by fusion of a thin solid film of the polymer on layers 12 and 14. Layer 16 of thermoplastic resinous polymeric material is usually in the order of from about ¼ to 5 mils thick and is preferably in the order of from about 1 to 3 mils thick.

In practice of this invention, the substantially pure electrical grade aluminum and aluminum alloys forming layers 12 and 14, respectively, should have several properties which are essential to a cable shielding tape providing mechanical and electrical protection for a cable. Beneficially, it has been found that the substantially pure electrical grade aluminum should be at least about 99 percent by weight pure aluminum and have an electrical conductivity of about 50 percent or greater of the IACS (International Annealed Copper Standard) and preferably has an electrical conductivity of about 57 percent IACS or greater. In addition, it has been found that the aluminum alloys advantageously used in the practice of this invention should have physical properties including an elongation to break of at least about 15 percent, a yield strength of at least about 13,000 pounds per square inch and a brinell hardness of at least about 30 (based on a 15 kilogram load on a 10 millimeter ball) to provide the necessary mechanical protection. The composition of aluminum alloys which will provide the above preferred physical properties comprises aluminum having a weight of less than 99 percent and a component selected from the group consisting essentially of magnesium having a weight percent from about 0.2 to about 6, manganese having a weight percent from about 0.1 to about 0.5, copper having a weight percent from about 0.1 to about 1, zinc having a weight percent from about 0.05 to about 2.5, silicon having a weight percent from about 0.1 to about 1, and mixtures thereof. Layer 12 of aluminum and layer 14 of aluminum alloy are usually in the order of about 6 mils to about 16 mils and about 4 mils to about 10 mils, respectively, for cable constructions.

Several substantially pure electrical grade aluminum and aluminum alloys which are particularly beneficial for use in layers 12 and 14 are commercially available. The designation, treatment, composition, and physical properties of such aluminum and aluminum alloys are illustrated in METALS HANDBOOK, Vol. 1, Properties and Selection of Metals, 8th ed., Copyright 1961, pages 935–950 and in ALCOA ALUMINUM HANDBOOK, Alcoa Company of America, Copyright 1956, pages 1–44. Substantially pure electrical grade aluminums which can be used beneficially to form layer 12 are commercially available under the designation of 1045, 1060, and 1100, which aluminums are about 99.45 percent, 99.60 percent and 99.00 percent by weight pure aluminum, respectively, and have electrical conductivity of about 62 percent, 62 percent and 59 percent IACS, respectively. Particularly beneficial commercially available aluminum alloys which have the desired physical properties in the annealed state for forming layer 14 are shown in the following Table I.

TABLE I

| Alloy | Nominal Composition wt. % Alloying Element | Yield Strength lbs./sq. in. | % Elongation to Break | Brinell Hardness 500 kg. load - 10 mm. ball | Conductivity % IACS |
|---|---|---|---|---|---|
| 5052 | 2.5 % - Mg.<br>0.25 % - Cr. | 13,000 | 30 | 47 | 35 |
| 5056 | 5.2 % - Mg.<br>0.1 % - Mn.<br>0.1 % - Cr. | 22,000 | 35 | 65 | 29 |
| 5086 | 4.0 % - Mg.<br>0.5 % - Mn. | 17,000 | 22 | 65 | 31 |
| 5154 | 3.5 % - Mg.<br>0.25 % - Cr. | 17,000 | 27 | 58 | 32 |
| 5456 | 5.0 % - Mg.<br>0.7 % - Mn.<br>0.15 % - Cu.<br>0.15 % - Cr. | 23,000 | 24 | 75 | 29 |

The physical properties of the aluminum alloys used to form layer 14 can also be improved by thermal and strain hardening treatments as illustrated in the above-identified handbooks.

In addition to the above-noted beneficial physical properties of the aluminum alloys used to form layer 14 to provide the desirable mechanical protection for a cable, it has also been found that the aluminum alloys should be selected so that their electrolytic potentials are not very different from that of the substantially pure aluminum of layer 12 thereby reducing the problem of bi-metallic galvanic corrosion caused as a result of interfacing metals having widely differing electrolytic potentials. Specifically, it has beneficially been found that the electrolytic solution potential of the aluminum alloys should be within about 0.05 volts of the substantially pure aluminum of layer 12 on the basis of N/10 calomel electrodes (53 grams sodium chloride and 3 grams hydrogen peroxide solution). The electrolytic solution potentials of commercially available substantially pure electrical grade aluminums and aluminum alloys which can be used to form layers 12 and 14 are shown in Table II below.

TABLE II

| Commercially Designated Alum./Alum. Alloy | Electrolytic Solution Potential-Volts Basis-N/10 Calomel Electrodes (53 g. NaCl + 3 g. $H_2O_2$ Sol.) |
|---|---|
| 1045 (EC Alloy) | 0.84 |
| 1060 | 0.84 |
| 1100 | 0.83 |
| 5052 | 0.85 |
| 5056 | 0.87 |
| 5086 | 0.88 |
| 5154 | 0.86 |
| 5456 | 0.87 |

In order to show the galvanic corrosion improvement of the cable shielding tapes in accordance with the present invention as related to other composite cable shielding tapes including aluminum and steel, a series of galvanic corrosion tests were run. The tests were run by forming a galvanic cell of aluminum and steel or aluminum alloy in a 0.1 normal hydrochloric acid solution at 25° C. The electrical current flowing through the cell was then recorded and the corrosion rate was determined by the use of Faraday's Law. The results of the tests are shown in Table III below.

TABLE III

| Metal Anode | Metal Cathode | Anode Area sq. cm. | Current milliamps | Corrosion Rate mils per year |
|---|---|---|---|---|
| Al 1045 | BPS (1) | 12.8 | 5.2 | 173 |
| Al 1045 | TPS (2) | 13.9 | 2.4 | 74 |

TABLE III-continued

| Metal Anode | Metal Cathode | Anode Area sq. cm. | Current milliamps | Corrosion Rate mils per year |
|---|---|---|---|---|
| Al 1045 | Al 5052 | 13.3 | 1.2 | 38 |

(1) BPS is black plated steel commonly used in cable shielding tapes
(2) TPS is tin plated steel commonly used in cable shielding tape The results of Table III illustrate that the galvanic corrosion protection provided by a cable shielding tape of 1045 aluminum and 5052 aluminum alloy is 2–3 times better than a composite shielding tape including tin plated steel and 4–5 times better than a composite shielding tape including black plated steel.

Figure 3:
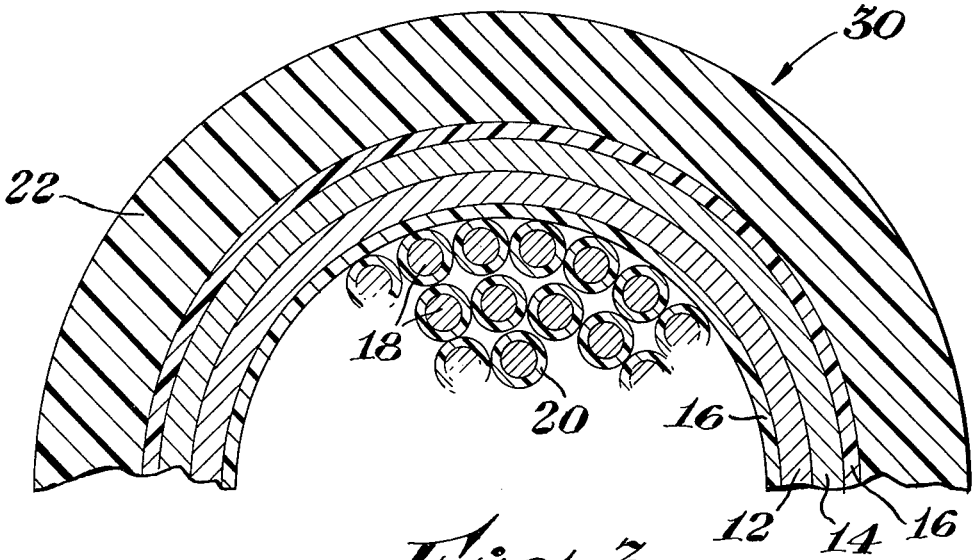
FIG. 3 is a partial exaggerated cross-sectional view of a typical cable including multiple conductors in the core, a metal shield, and a plastic outer jacket.

More specifically referring to FIG. 3, a cable 30 for use while buried in the ground is illustrated. The cable 30 includes a core of multiple conductors 18 surrounded by insulation 20. The conductors 18 and insulation 20 are surrounded by a longitudinally folded cable shielding tape including inner and outer layer 16 of thermoplastic resinous polymeric material, preferably a copolymer of ethylene and an ethylenically unsaturated carboxylic acid, a layer 12 of substantially pure electrical grade aluminum such as that commercially designated as 1045, 1060 or 1100, and a layer of aluminum alloy such as commercially designated as 5052, 5056, or 5154. The core of multiple conductors 18 surrounded by insulation 20 and cable shielding tape of layers 12, 14 and 16 are finally surrounded by a seamless outer jacket 22, preferably of polyethylene. Beneficially, the outer jacket 22 is a polymer of ethylene such as polyethylene containing the usual stabilizers and approximately 2.5 percent by weight of carbon black for maximum protection against ultraviolet light. Polyethylene is also commonly used for the insulation 20 of conductors 18 and for these purposes the polyethylene, containing the usual stabilizers, may also contain carbon black if desired, but ordinarily is used without carbon black and may contain white pigments or coloring matter for coding.

While certain representative embodiments and details have been shown for the purpose of illustrating the invention, it will be apparent to those skilled in the art that various changes and modifications can be made therein without departing from the spirit and the scope of the invention. For example, the cable shielding tape of the present invention can be wrapped around the cable core, either longitudinally or helically, with a small overlap. The cable shielding tape may also be corrugated or left smooth. In addition, if the cable shielding tape is coated on at least one side with a copolymer of ethylene and an ethylenically unsaturated carboxylic acid and a jacket of polyethylene is used, the heat of extrusion will suffice in bonding the jacket to the cable shielding tape and in sealing the overlap in the cable shielding tape to provide a hermetic seal.

What is claimed is:

1. A cable shielding tape comprising a first layer of substantially pure aluminum bonded to a second layer of aluminum alloy, said aluminum alloy having an elongation to break of at least about 15 percent, a yield strength of at least about 13,000 pounds per square inch, a brinell hardness of at least about 30 and an electrolytic solution potential within about 0.05 volts of the substantially pure aluminum on the basis of N/10 calomel electrodes.

2. The cable shielding tape of claim 1 wherein a first layer of thermoplastic resinous polymeric material is adhered to one side of said tape.

3. The cable shielding tape of claim 2 wherein a second layer of thermoplastic resinous polymeric material is adhered to the opposite side of said tape, said tape being disposed between said layers of thermoplastic resinous polymeric material.

4. The cable shielding tape of claim 2 wherein said polymeric material is a copolymer of ethylene and an ethylenically unsaturated carboxylic acid.

5. The cable shielding tape of claim 4 wherein said unsaturated carboxylic acid is acrylic acid.

6. The cable shielding tape of claim 1 wherein a third layer of substantially pure aluminum is bonded to the opposite side of said second layer of aluminum alloy, said second layer of aluminum alloy being disposed between said layers of substantially pure aluminum.

7. The cable shielding tape of claim 6 wherein a first layer of thermoplastic resinous polymeric material is adhered to one side of said tape.

8. The cable shielding tape of claim 7 wherein a second layer of thermoplastic resinous polymeric material is adhered to the opposite side of said tape, said tape being disposed between said layers of thermoplastic resinous polymeric material.

9. The cable shielding tape of claim 7 wherein said polymeric material is a copolymer of ethylene and an ethylenically unsaturated carboxylic acid.

10. The cable shielding tape of claim 9 wherein said unsaturated carboxylic acid is acrylic acid.

11. A cable shielding tape comprising at least one layer of aluminum which is at least about 99 weight percent pure aluminum bonded to at least one layer of aluminum alloy, said alloy comprising aluminum having a weight of less than 99 percent and a component selected from the group consisting essentially of magnesium having a weight percent from about 0.2 to about 6, manganese having a weight percent from about 0.1 to about 2, chromium having a weight percent from about 0.1 to about 0.5, copper having a weight percent from about 0.1 to about 1, zinc having a weight percent from about 0.05 to about 2.5, silicon having a weight percent from about 0.1 to about 2, iron having a weight percent from about 0.1 to about 1 and mixtures thereof.

12. The cable shielding tape of claim 11 wherein a first layer of thermoplastic resinous polymeric material is adhered to one side of said tape.

13. The cable shielding tape of claim 12 wherein a second layer of thermoplastic resinous polymeric material is adhered to the opposite side of said tape, said tape being disposed between said layers of thermoplastic resinous polymeric material.

14. The cable shielding tape of claim 12 wherein said polymeric material is a copolymer of ethylene and an ethylenically unsaturated carboxylic acid.

15. The cable shielding tape of claim 14 wherein said unsaturated carboxylic acid is acrylic acid.

16. The cable shielding tape of claim 11 wherein a second layer of aluminum which is at least about 99 weight percent pure aluminum is bonded to the opposite side of said layer of aluminum alloy, said layer of aluminum alloy being disposed between said layers of aluminum.

17. The cable shielding tape of claim 16 wherein a layer of thermoplastic resinous polymeric material is adhered to one side of said tape.

18. The cable shielding tape of claim 17 wherein a second layer of thermoplastic resinous polymeric material is adhered to the opposite side of said tape, said tape being disposed between said layers of thermoplastic resinous polymeric material.

19. The cable shielding tape of claim 17 wherein said polymeric material is a copolymer of ethylene and an ethylenically unsaturated carboxylic acid.

20. The cable shielding tape of claim 19 wherein said unsaturated carboxylic acid is acrylic acid.

21. A cable for the transmission of electric power or communications comprising a core including insulated conductor means, a shield completely surrounding the circumference of said core and an outer jacket of insulation over the outside of said shields, said shield comprising a tape having a first layer of substantially pure aluminum bonded to a second layer of aluminum alloy, said aluminum alloy having an elongation to break of at least about 15 percent, a yield strength of at least about 13,000 pounds per square inch, a brinell hardness of at least about 30 and an electrolytic solution potential within about 0.05 volts of the substantially pure aluminum on the basis of N/10 calomel electrodes.

22. The cable of claim 21 wherein a first layer of thermoplastic resinous polymeric material is adhered to one side of said tape.

23. The cable of claim 22 wherein a second layer of thermoplastic resinous polymeric material is adhered to the opposite side of said tape, said tape being disposed between said layers of thermoplastic resinous polymeric material.

24. The cable of claim 22 wherein said polymeric material is a copolymer of ethylene and an ethylenically unsaturated carboxylic acid.

25. The cable of claim 24 wherein said unsaturated carboxylic acid is acrylic acid.

26. The cable of claim 21 wherein a third layer of substantially pure aluminum is bonded to the opposite side of said second layer of aluminum alloy, said second layer of aluminum alloy being disposed between said layers of substantially pure aluminum.

27. The cable of claim 26 wherein a first layer of thermoplastic resinous polymeric material is adhered to one side of said tape.

28. The cable of claim 27 wherein a second layer of thermoplastic resinous polymeric material is adhered to the opposite side of said tape, said tape being disposed between said layers of thermoplastic resinous polymeric material.

29. The cable of claim 27 wherein said polymeric material is a copolymer of ethylene and an ethylenically unsaturated carboxylic acid.

30. The cable of claim 29 wherein said unsaturated carboxylic acid is acrylic acid.

* * * * *